United States Patent [19]

Scheinhaus et al.

[11] 4,446,633

[45] May 8, 1984

[54] BIOMECHANICAL FOOTWEAR

[76] Inventors: Myron G. J. Scheinhaus, 3918 Libbit Ave., Encino, Calif. 91316; Paul R. Jacobson, 354 S. LaFayette Park Pl., Apt. 304, Los Angeles, Calif. 90057; Allen J. Selner, 3918 Libbit Ave., Encino, Calif. 91316

[21] Appl. No.: 384,894

[22] Filed: Jun. 4, 1982

[51] Int. Cl.[3] ..... A43B 03/12; A43B 13/00

[52] U.S. Cl. ..... 36/11.5; 36/30 R; 36/59 C; D2/320; D2/290; 128/584

[58] Field of Search ..... 36/11.5, 30 R, 25 R, 36/44, 59 C; 128/80 D, 81 R, 153, 584, 585, 596, 601; D2/292, 294, 317, 320, 322

[56] References Cited

U.S. PATENT DOCUMENTS

| | | | |
|---|---|---|---|
| 1,400,428 | 12/1921 | Greenough | 36/30 R |
| 1,587,377 | 6/1926 | Grosjean | 36/30 R |
| 2,333,201 | 11/1943 | Russell | 36/30 R |
| 3,006,085 | 10/1961 | Bingham, Jr. | 36/59 C |
| 3,063,457 | 11/1962 | Bittner et al. | 128/81 R |
| 4,200,997 | 5/1980 | Scheinhaus et al. | 36/11.5 |

FOREIGN PATENT DOCUMENTS

| | | | |
|---|---|---|---|
| 2813579 | 10/1979 | Fed. Rep. of Germany | 36/11.5 |
| 7508844 | 12/1974 | France | 36/30 R |

*Primary Examiner*—Werner H. Schroeder
*Assistant Examiner*—Steven N. Meyers
*Attorney, Agent, or Firm*—Sellers and Brace

[57] ABSTRACT

A biomechanical article of footwear constructed to assure proper control of pronation and supination of the wearer's foot during locomotion achieved primarily by coordinate action of an extended varus wedge molded into the inner side of the heel and arcuate ribs in the forward half of the outsole designed to collapse and expedite torquing and reduce shearing forces of the foot and leg during med-stance propulsion. These important features are supplemented beneficially by an insole assembly including a material which takes a set during initial use in conformity with load bearing surfaces of the foot, and raised areas of the sole assembly beneath metatarsal arch to aid uniform weight distribution, and by a toe crest. Additionally and importantly improved self-adjusting strapping is provided to hold the sole assembly to the foot. This strapping includes a toe-embracing loop designed to hold the forward end of the foot firmly between the lateral edges of the sole assembly while leaving other portions of the strapping free for adjustment longitudinally of straight open-ended passages extending crosswise of the sole assembly.

18 Claims, 10 Drawing Figures

BIOMECHANICAL FOOTWEAR

This invention relates to footwear, and more particularly to a unique biomechanical article of footwear designed to compensate for various abnormal foot and leg conditions by automatically aligning and relaxing the skeletal and muscular complex of the foot and leg during pronation at step down and stabilizing this complex during pushoff supination.

BACKGROUND OF THE INVENTION

The activities of many people are greatly restricted owing to afflictions directly and even indirectly associated with improper footwear and certain imperfections in the skeletal and muscular complex of the foot and leg. These can cause severe foot and leg fatigue, arch strain, tendonitis, callouses, bunions, as well as knee, lower back and neck pain. If the skeletal leg and foot elements are in proper alignment the person enjoys superior control during both pronation and supination phases of the locomotion or gait cycle.

Under normal and proper physiological conditions during step-down, the foot and leg pronate inwardly through a limited arc transversely of the body whereas during pushoff the foot and leg supinate outwardly through a similar reverse arc. During pronation of the normal foot and leg, the heel and hip rolls inwardly as the forward half of the foot pivots generally about an axis offset inwardly from the inner or medial lateral edge of the foot. Pronation occurs as the heel strikes the ground and applies sufficient pressure to the rear inner corner of the heel which acts to unlock the foot complex from its relatively inflexible condition and rendering it very flexible and effective to absorb shock and stability during step-down.

During the pushoff phase of locomotion the foot and leg rolls in the reverse direction and this is known as supination. At this time the foot complex resumes its relatively rigid inflexible condition thereby enabling one to push forwardly firmly with the entire foot.

Many persons are afflicted with misaligned leg and foot complexes wherein the leg bones do not lie in a generally vertical plane. In consequence, pronation and supination do not occur normally with the result that the foot complex does not unlock and relock in the proper sequence essential for maximum ease, comfort and effectiveness of locomotion. Proposals have been made for utilizing a varus wedge at the inner rear corner of the heel to compensate for misalignment conditions but, these are frequently inadequate and ineffective to unlock the foot complex timely during step-down and mid-stance or to restore this complex to controlled relocked stable condition during pushoff. In consequence the victim is subject to some or many afflictions and discomforts including bunions, callouses leg fatigue, knee pain, hammer toes, low back and neck pain, etc.

Contributing to these afflictions in many instances is the absense in prior footwear of appropriate provisions to facilitate and reduce the resistance to the small natural outward torquing of the foot and knee known as supination and associated with the pushoff phase of gait.

Other shortcomings of prior art footwear are the lack of provision to facilitate stabilization of the foot complex together with simple self-adjusting strapping for holding the footwear to the foot alone or in combination with an insole of material effective to take a generally permanent set in conformity with the juxtaposed plantar areas in load bearing contact therewith or supplemented with means for aiding the support of the metatarsal and toecrest arches.

In recognition of the need of a large segment of mankind for more appropriate and beneficial footwear, many proposals have been made heretofore for footwear designed to alleviate physiological conditions and discomforts associated with the feet and locomotion. Examples of these include the teachings of such United States patents as: Yates U.S. Pat. No. 2,642,677, Scholl U.S. Pat. No. 3,323,233, Fukuoka U.S. Pat. No. 3,468,040, Miyachi et al U.S. Pat. No. 3,675,346, Stafford U.S. Pat. No. 3,707,784, Scrima U.S. Pat. No. 3,825,017, Jackson U.S. Pat. No. 3,968,577 and Krug et al U.S. Pat. No. 4,130,948. Although individual features of these prior proposals have been helpful to a degree they have many shortcomings and fall far short of the needs of many people. In particular, these prior teachings fail to take into account the many interrelated physical aspects of locomotion especially when associated with misalignment conditions and the shock stresses generated at step-down and the functional needs during pushoff.

SUMMARY OF THE INVENTION

This invention provides an article of footwear avoiding the aforementioned and other shortcomings of prior footwear. These ends are achieved, in part, by a specially constructed sole assembly incorporating a variety of features each designed to cooperate with the skeletal and muscular complex of the foot to assure proper functioning of these complexes and to compensate for various commonly-occurring abnormalities.

Typically and by way of example, these objectives are obtained by a sole assembly formed in two principal subassemblies, including an outsole sub-assembly and novel self-adjusting strapping for holding the latter to the foot. The sole assembly may comprise a unit of elastomeric material featuring on its outer forward end a multiplicity of arcuate ribs arranged to collapse automatically to minimize resistance to and facilitate natural torquing of the foot and leg during step-down and mid-stance as well as during push-off of the foot. The sole assembly is also provided with an elongated varus wedge along substantially the full length of the inner side of the heel as well as with a raised surface beneath the metatarsal arch and a star-like raised area beneath the toe crest. The insole includes one or more layers of self-forming lightweight plastic foam material such as Plasazote or Frelen enclosed along its perimeter and upper side by an appearance covering. A further important feature is automatically adjustable strapping comprising a pair of straps having their remote ends anchored to the opposite sides of the insole with an intermediate portion of each passing through a flattened tubular passage extending between and transversely of the midlength of the sole assembly. The first or forward strap includes a toe embracing loop and a free end which encircles the ankle and criss-crosses the arch. The free end of the second strap forms a heel embracing loop extending through the ankle loop of the first strap and including a free end releasably and adjustably securable to the free end of the first strap. The toe, ankle and heel loops are automatically adjustable to fit the wearer's foot by virtue of the adjustability of each strap in the respective one of its supporting tubular passages.

These and other more specific objects will appear upon reading the following specification and claims and upon considering in connection therewith the attached drawing to which they relate.

Referring now to the drawing in which a preferred embodiment of the invention is illustrated:

Figure 9:
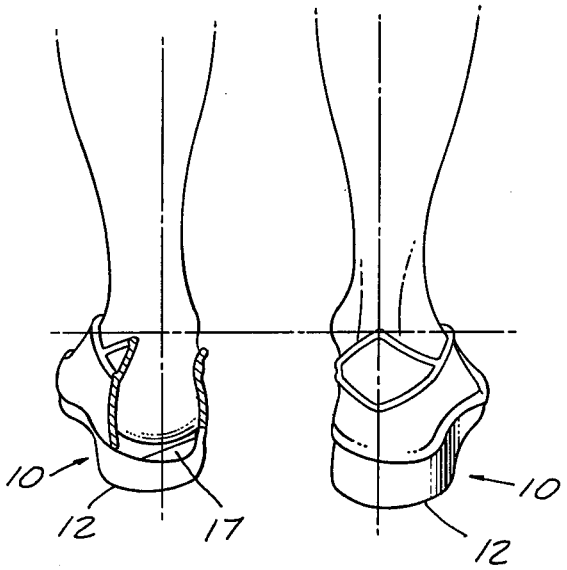
Figure 10:
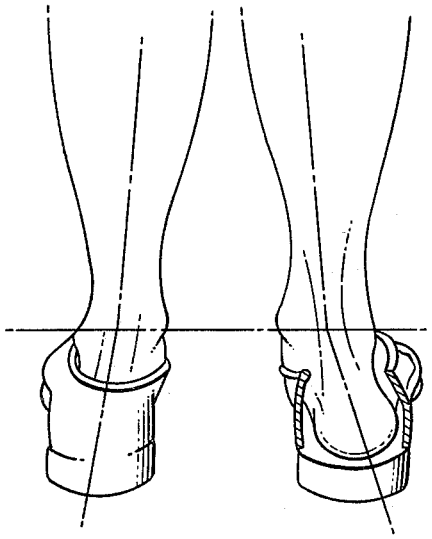

FIG. 9 is a fragmentary generally elevational view from the rear of a person wearing footwear incorporating a varus wedge of this invention dimensioned to counteract the natural non-aligned condition of the lower legs, ankle joint and heel bone; and FIG. 10 is a view similar to FIG. 9 showing the stance of the same person wearing footwear without a varus wedge and showing an exaggerated non-aligned condition of the lower leg's ankle joint and heel bone.

Figure 1:
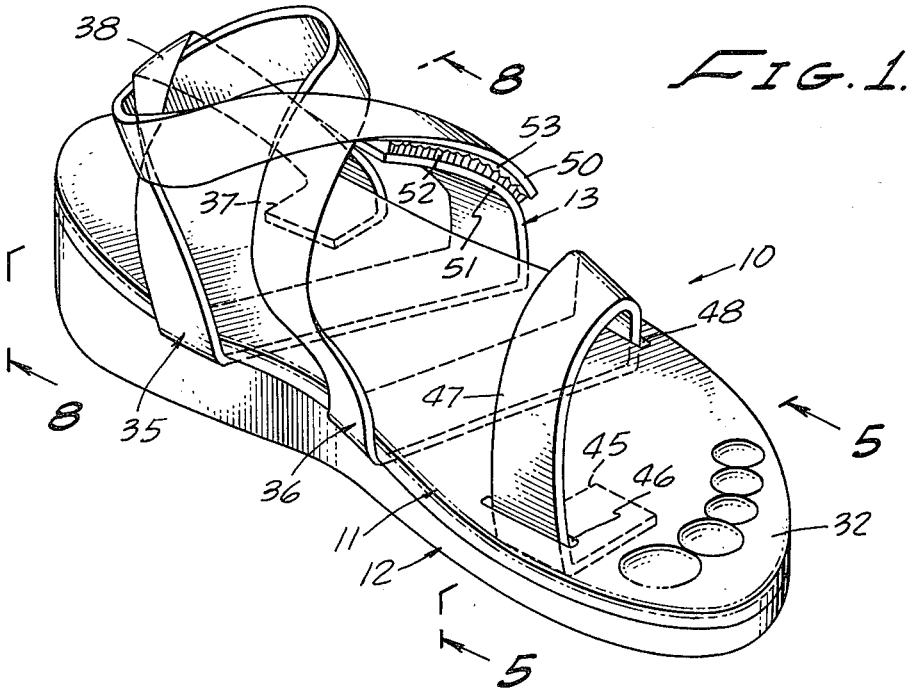
FIG. 1 is a perspective view of an illustrative embodiment of the invention footwear showing the strapping in closed position.

Referring initially to FIG. 1 there is shown an illustrative embodiment of the invention footwear, designated generally 10, in the form of a sandal and comprising an insole unit 11, an outsole 12 and strapping 13. The insole unit 11 is shown in a bottom perspective view in FIG. 4 whereas top and bottom views of the outsole unit 12 are shown in top FIGS. 2 and 3.

Figure 2:
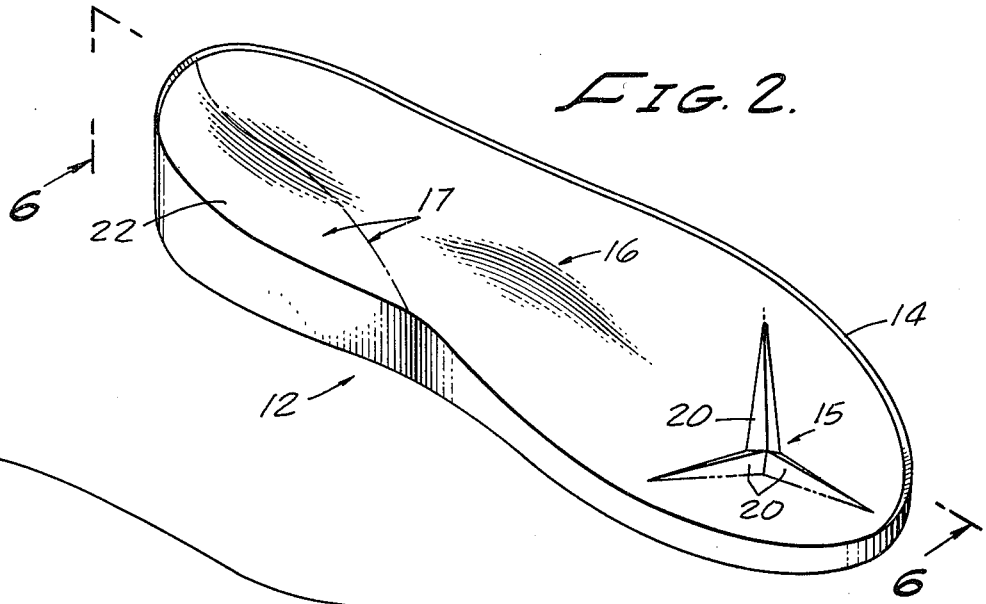
FIG. 2 is a top perspective view of the outsole unit.
Figure 5:
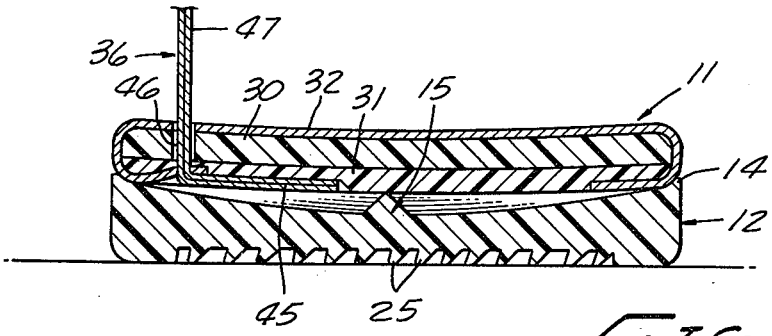
FIG. 5 is a cross sectional view on an enlarged scale taken along line 5—5 of FIG. 1.
Figure 6:
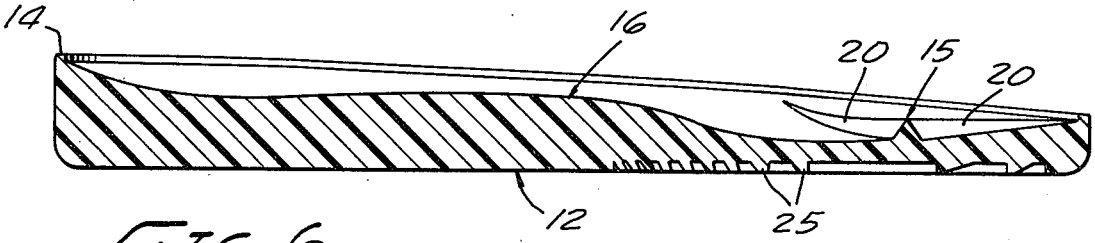
FIG. 6 is a longitudinal cross sectional view taken along line 6—6 on FIG. 2.
Figure 7:
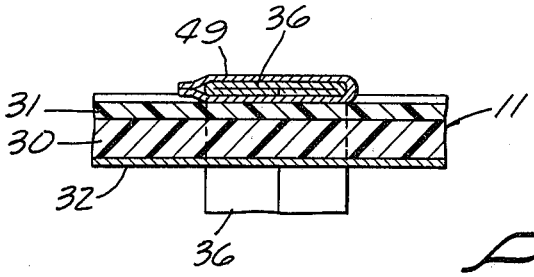
FIG. 7 is a fragmentary cross sectional view on an enlarged scale taken along line 7—7 on FIG. 4.

Outsole 12 comprises a one piece molding of flexible resilient elastomeric material of high abrasion resistent qualities. The upwardly facing surface is dish-shaped from end-to-end and side-to-side as illustrated in FIGS. 2, 5 and 6 and includes an upright low-height flange 14 along its peripheral rim edge and specially contoured elevated areas indicated at 15, 16 and 17 in FIG. 2. Elevated area 15 comprises a plurality of radial ribs 20. These ribs have a maximum height at their junction centrally beneath the toe crest arch, are of V-shape in cross section and taper into merger with the outsole surface forwardly of their common junction and rearwardly thereof to either lateral side of the outsole. As shown, these ribs are approximately 120 degrees apart. As shown ribs 20 are 120 degrees apart. As is best shown in FIG. 2, one rib is substantially longer and extends rearwardly and outwardly towards the outer lateral edge of the outsole.

The elongated upwardly-rounded area 16 underlies the metatarsal arch and is so shaped that its perimeter merges with the adjacent surface of the outsole in a generally eliptical path having its longer axis extending lengthwise of the outsole.

Figure 8:
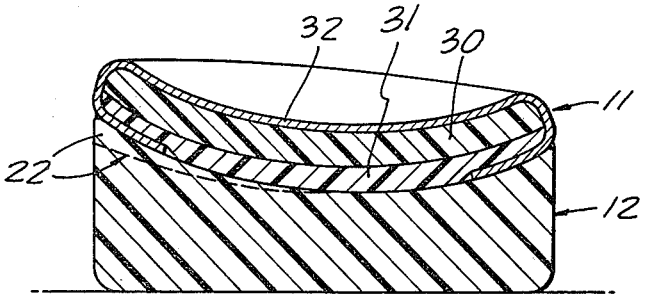
FIG. 8 is a cross sectional view through the sole assembly taken along line 8—8 on FIG. 1.

The extended varus wedge 17 is of particular importance and significance and extends along the full length of the inside of the heel with its thickest or highest area extending along the inner or medial lateral edge of the heel as is generally indicated at 22 in FIGS. 2 and 8. The remainder of the upper surface of the wedge tapers inwardly toward the center of the heel along a curved surface conforming generally to the juxtaposed surface of the wearer's heel. The taper of this curved surface the lower imaginary side of which is indicated by the dotted line 22 in FIG. 8, is typically 4 degrees to 5 degrees but may be less or greater to meet the needs of a particular user. This shallow wedge is adequate to assure tilting of the heel bone as the heel contacts a firm surface to allow unlocking of the joints between the calcaneus, talus and navicular bones as well as reducing excessive pronation and maintaining these joints (in a stable position) into the mid-stance phase of locomotion. This permits stabilization of the remainder of the skeletal and muscular complexes of the foot thereby enabling these complexes to absorb the high energy shocks incident to step-down and the transfer of the entire body weight to one foot.

Persons having the many ailments and infirmities associated with non-aligned leg and foot conditions, such as the somewhat exaggerated examples illustrated in FIG. 10 are aided to a marked degree by extended varus wedge 22 and by the conjoint functioning of this wedge with ribs 15, the raised area 16, the specially constructed insole and the collapsing arcuate ribs on the bottom of the outsole to be described presently.

The upper surface of the heel end of outsole 12 is cupped and contoured and importantly, includes an integral varus wedge extending for the full length of the inner side of the heel and the inner rear quadrant thereof. Its upper surface tapers upwardly from a smooth merger with the heel seating surface, as is indicated by the dot and dash line 17 in FIG. 2, at a suitable angle such as 3 degrees to 5 degrees. This inner feather edge of the wedge extends from the inner peripheral edge of the merger of the heel with the instep rearwardly along the central portion of the heel cup and into a merger with the rear edge of the heel. This extended varus wedge aids in correcting and overcoming the nonaligned abnormal leg and foot condition illustrated in FIG. 10 and greatly relieves if not eliminates numerous ailments and discomforts otherwise commonly suffered. As the wearer steps down the inner rear corner of the heel contacts the ground first and wedge 17 applies pressure to the heel bone joint to stabilize the foot complex and enables the bones to flex and cooperate in absorbing the shock of step-down. Moreover, and owing to the extended forward end of wedge 17, this wedge continues to apply pressure to the heel joint to maintain this highly desirable unlocked condition into mid-stance while eliminating any excessive motion.

Figure 3:
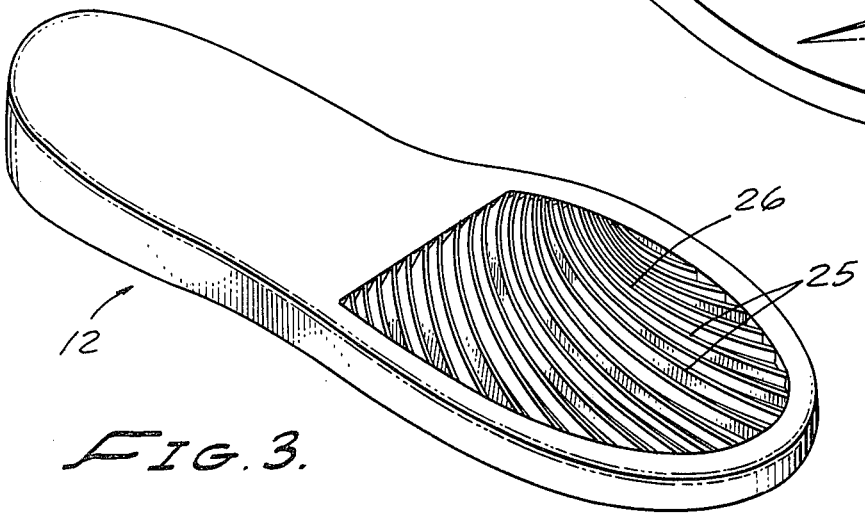
FIG. 3 is a corresponding bottom perspective view of the outsole.
Figure 4:
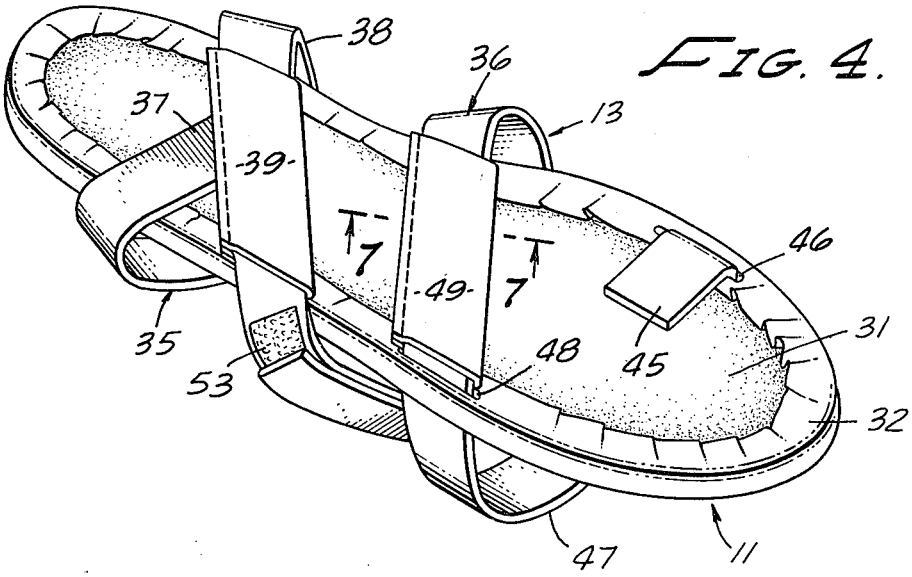
FIG. 4 is a bottom perspective view of the insole unit.

Another important feature of outsole 12 will now be described with reference to FIGS. 3, 5, and 6. There shown is a multiplicity of arcuate ribs 25 molded integral with the outsole. These ribs have a center indicated at 26 in FIG. 3 which is spaced outwardly of the inner lateral edge of the outsole by a suitable distance, such as five to six inches. Ribs 25 are generally V-shape in cross section and inclined inwardly and downwardly as shown in FIG. 5, and are shaped to collapse partially to minimize resistence to normal outward roll of the foot and leg associated with supination during the push-off phase of gait.

Preferably, the insole unit 11, best shown in FIGS. 4, 5, 7 and 8 comprises a relatively thick upper layer 30 of closed cell porous elastomeric material, a relatively thinner, relatively firm but flexible elastomeric layer 31 laminated together within a suitable appearance cover 32 embracing the upper and peripheral surfaces of layers 30 and 31. Layer 30 is a well known commercially available elastomer having pronounced cushioning properties and an extremely poor memory with the result that after a few days wear this layer takes a permanent set in conformity with the juxtaposed plantar surface of the wearer's foot. The underlying layer 31 is resilient flexible and has relatively good memory characteristics and supplements both the outsole and layer 30 in absorbing shock forces, particularly during step-down.

The sole assembly units 11 and 12 may be held to the wearer's foot in various ways but preferably by unique automatically self-adjusting FIG. 8 strapping, designated generally 13. This strapping includes a relatively short first strap 35 and a relatively long second strap 36 (FIG. 1) having their remote ends anchored respectively to the heel and toe ends of the sole unit. Thus, as is made clear by FIG. 1, the rear end 37 of strap 35 is initially firmly bonded to the outer underside of the heel end of insole 11 and then extends upwardly and across the heel to form a heel embracing loop 38. The inner end of loop 38 then enters a flat tubular member 39 (FIG. 4) extending diagonally crosswise of the instep portion of the sole unit. The opposite ends of the tubular member 39 open axially through the opposite sides of the sole unit closely adjacent the lateral edges thereof.

The forward end 45 of the second strap 36 is initially firmly anchored to the underside of insole 11 adjacent the forward inner lateral edge thereof and passes upwardly through a slit 46 in the manner best shown in FIGS. 1–4. Strap 36 then extends diagonally across the forward end of the footwear to form a toe-embracing loop 47. The outer end of this loop passes through a slit 48, adjacent the outer edge of an insole and into a second flat tubular member 49 (FIG. 4) extending diagonally crosswise of the footwear generally parallel to tubular member 39. Strap 36 exits axially from the inner end of member 49 and passes upwardly, diagonally across the wearer's ankle and through heel loop 38. The free ends 50 and 51 of the first and second straps overlap one another crosswise of the ankle and are provided with suitable fastener means for securing the same detachably together. Preferably, strap end 51 is provided with a multiplicity of hooked barbs 52 and strap end 50 is provided with a thick mat of strong fibers 53 which readily interlock with these barbs.

The insole unit 11 and the outsole unit 12 are firmly laminated together by a suitable strong adhesive with the upstanding flange 14 encircling the perimeter of outsole 12 hugging the adjacent perimeter surfaces of the insole appearance cover 32. As clearly appears from FIG. 1, when these two units are assembled both ends of the toe embracing loop 47 are anchored in slits 46 and 48 thereby holding the toe end of the wearer's foot against shifting laterally of the footwear. Both the first and second straps 35, 36 can shift freely lengthwise of tubular members 39 and 49 while the free ends 50 and 51 of the straps are disengaged and as necessary for a firm and comfortable fit about all adjacent portions of the wearer's foot. Moreover, this adjustment of the straps can occur after engagement of the strap ends and during walking since all portions of the straps between the anchored ends 37 and 45 are free to shift lengthwise of members 31 and 45. In consequence, the described FIG. 8 strapping is self-adjusting and applies light, uniformly-distributed pressure to the juxtaposed surfaces of the foot.

While the particular biomechanical footwear herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. Biomechanical footwear comprising:

an outsole of wear-resistant elastomeric material of greater thickness at the heel than at the toe end thereof;

an insole unit secured to the upper side of said outsole and including a layer of porous elastomeric material adapted to take a permanent set in conformity with the wearer's plantar foot surface;

means secured to edge portions of said outsole and insole for holding said footwear on the wearer's foot;

said outsole having a contoured generally-dished upper surface including:

(1) a concave heel-seating area having the inner side thereof formed with an integral varus wedge inclined upwardly and outwardly generally at an angle of a few degrees from the center of said heel-seating area and terminating adjacent the forward end thereof;

(2) a plurality of ribs integral with the forward end of said dished surface, said ribs radiating and tapering outwardly from a junction of maximum height centrally beneath the wearer's toe crest and merging with said dished surface at points respectively located forwardly and rearwardly of said toe crest; and (3) the lower surface of the major portion of the forward end of said outsole having a multiplicity of spaced-apart arcuate ribs each having a center spaced outwardly from the inner lateral edge of said major forward end portion of said outsole, and said arcuate ribs being shaped and arranged to flex and partially collapse as the wearer's foot and leg supinates during pushoff.

2. Biomechanical footwear as defined in claim 1 characterized in that said ribs beneath said toe crest include a forwardly extending rib and a pair of rearwardly diverging ribs.

3. Biomechanical footwear as defined in claim 1 characterized in that said ribs beneath said toe crest are triangular in cross section with one crest of each uppermost and merging at said junction of maximum height.

4. Biomechanical footwear as defined in claim 1 characterized in that said ribs beneath said toe crest radiate from and are spaced apart generally equidistantly about said junction of maximum height.

5. Biomechanical footwear as defined in claim 1 characterized in that the midlength of the dished upper surface of said outsole includes an integral elongated convex portion extending lengthwise thereof beneath the wearer's metatarsal arch.

6. Biomechanical footwear as defined in claim 1 characterized in that said arcuate ribs on the lower surface of said outsole are inclined outwardly and generally toward the inner lateral edge of the forward end portion of said outsole.

7. Biomechanical footwear as defined in claim 1 characterized in that said means for securing said footwear to the wearer's foot comprises:

first and second flat tubular passages arranged at an acute angle in the same direction crosswise of the midlength and between said insole and outsole, the foremost end of said second passage opening upwardly through said insole near one lateral edge thereof and the remaining ends of said first and second passages opening upwardly through said insole near one lateral edge thereof and the remaining ends of said first and second passages opening horizontally outwardly between the adjacent lateral edges of said insole and outsole;

first and second straps having their remote ends secured to and between the opposite edges of said insole and outsole adjacent the opposite ends thereof;

said first strap having the rear end portion thereof forming a heel-embracing loop and its forward end portion passing through said first passage with its free end exposed;

said second strap having its forward end portion forming a toe embracing loop before passing through said second passage and having its rear end portion operatively connected with said heel-embracing loop and arranged to cooperate with said first strap to form a figure-eight loop about the wearer's heel and arch; and means for releasably and adjustably securing the free ends of said first and second straps together.

8. Biomechanical footwear as defined in claim 7 characterized in the provision of strap-receiving slits tbrough the opposite lateral edges at the forward end portion of said insole to accommodate a respective end of the toe-embracing loop of said second strap and cooperating with said toe-embracing loop to hold the forward end of the foot firmly captive and against lateral shift crosswise of said insole, and the portion of said insole rearwardly of said toe-embracing loop being free of strap-receiving slits.

9. Biomechanical footwear as defined in claim 8 characterized in that the free end of said second strap is threaded through said heel-embracing loop from the outer lateral side thereof and then extends outwardly across the forward side of the wearer's ankle.

10. Biomechanical footwear as defined in claim 1 characterized in that said outsole is molded in one piece from polyurethane.

11. Biomechanical footwear as defined in claim 1 characterized in that said insole and said outsole are bonded together substantially throughout the juxtaposed surfaces thereof.

12. Biomechanical footwear as defined in claim 1 characterized in that said insole includes an appearance cover embracing the upper side and peripheral edges of said porous elastomeric material.

13. Biomechhnical footwear as defined in claim 12 characterized in that said insole includes a plurality of layers of said porous elastomeric material secured together which layers have different physical properties.

14. Biomechanical footwear as defined in claim 13 characterized in that the outermost layer of elastomeric material is relatively thick and takes a permanent set in conformity with the wearer's plantar surface whereas an underlying layer of said elastomeric material is relatively more rigid and tends to resume its original dimensions upon removal of loading.

15. Biomechanical footwear as defined in claim 1 characterized in that the upper peripheral edge of said outsole includes a low-height upwardly projecting flange snugly embracing the juxtaposed peripheral edge of said insole.

16. Biomechanical footwear comprising:

a one-piece outsole molded from wear-resistant elastomeric material substantially thicker in the heel-forming portion than in the forward end portion thereof;

an insole unit including an outer appearance cover concealing the top and periphery of at least one layer of porous elastomeric material of a type having the property of taking a generally permanent set in conformity with the plantar surface of the wearer's foot;

means for holding said insole and outsole inseparably assembled, and means anchored thereto for holding the same to a wearer's foot;

the major outer bottom portion of said outsole having molded thereto a multiplicity of arcuate ribs each having a center spaced outwardly from the inner lateral edge of said outsole;

said arcuate ribs being inclined downwardly and generally toward the inner lateral edge of said outsole and adapted to collapse to minimize resistance to supination of the wearer's foot and leg during pushoff.

17. Biomechanical footwear comprising:

an outsole molded from wear-resistant elastomeric material substantially thicker in the heel-forming position than in the forward portion thereof:

an insole including a layer of porous elastomeric material of a type having the property during the use of said footwear of taking a generally permanent set in conformity with the plantar surface of the wearer's foot;

means for holding said insole and said outsole inseparably assembled including means anchored thereto for holding the same to the wearer's foot; and the major outer bottom portion of said outsole having a multiplicity of resilient arcuate ribs molded therein of generally V-shape in cross section each having a center spaced outwardly from the inner lateral edge thereof which ribs are slightly inclined toward said inner lateral edge of said outsole and adapted to partially collapse during pushoff to minimize resistance to supination of the wearer's foot and leg.

18. Biomechanical footwear as defined in claim 17 characterized in that said outsole has molded in the upper surface thereof a concave heel-seating area provided with an integral varus wedge along the inner lateral side thereof which varus wedge is inclined upwardly and outwardly at an angle of a few degrees from the center of said heel-seating area and terminating adjacent the forward end thereof.

* * * * *